US006799592B1

(12) United States Patent
Reynolds

(10) Patent No.: US 6,799,592 B1
(45) Date of Patent: Oct. 5, 2004

(54) COLLAPSIBLE KNEE CRUTCH

(76) Inventor: Fletcher H. Reynolds, 7200 Springer Rd., McCalla, AL (US) 35111

( * ) Notice: Subject to any disclaimer, the term of this patent is extended or adjusted under 35 U.S.C. 154(b) by 0 days.

(21) Appl. No.: 10/287,551

(22) Filed: Nov. 4, 2002

(51) Int. Cl.[7] ..... A45B 9/00
(52) U.S. Cl. ..... 135/74; 602/16
(58) Field of Search ..... 135/65, 66, 68, 135/69, 74; 602/16

(56) References Cited

U.S. PATENT DOCUMENTS

| | | | | | |
|---|---|---|---|---|---|
| 2,827,897 | A | * | 3/1958 | Pawlowski | 602/16 |
| 4,058,119 | A | * | 11/1977 | Rosequist | 602/5 |
| 4,141,375 | A | | 2/1979 | Tykwinski | 135/66 |
| 4,291,715 | A | | 9/1981 | Monte | 135/68 |
| 4,910,927 | A | | 3/1990 | Beatty | 135/66 |
| 5,178,595 | A | | 1/1993 | MacGregor | 482/75 |
| 5,300,016 | A | | 4/1994 | Marlatt | 602/16 |
| 5,575,299 | A | | 11/1996 | Bieri | 135/66 |
| 5,746,236 | A | | 5/1998 | Tisley et al. | 135/66 |
| 5,941,263 | A | | 8/1999 | Bierman | 135/68 |

* cited by examiner

*Primary Examiner*—Ramon O. Ramirez
*Assistant Examiner*—Kofi Schulterbrandt
(74) *Attorney, Agent, or Firm*—Walker, McKenzie & Walker, P.C.

(57) ABSTRACT

A collapsible knee crutch including an upper leg member, a lower leg member, a lower leg pivot pivotally attaching the upper and lower leg members together for allowing the lower leg member to pivot between a bent position and an extended position, a support leg member, and a support leg pivot for pivotally attaching the lower leg member and the support leg member together for allowing the support leg to pivot between a bent position and an extended position. The lower leg pivot has a pivotal axis located forward of the user's natural knee pivotal axis when the crutch is attached to the user's leg. The support leg member has elongated, spaced apart inside and outside support legs with the outside support leg being longer than the inside support leg.

4 Claims, 3 Drawing Sheets

COLLAPSIBLE KNEE CRUTCH

BACKGROUND OF THE INVENTION

1. Field of the Invention

The present invention relates to a knee crutch that can be attached to a user's upper leg or thigh, support the user's lower leg in a bent position, and provide stable support for the user.

2. Information Disclosure Statement

A preliminary patentability search in Class 135, subclasses 66, 68 and 69, and in Class 602, subclasses 16 and 26, produced the following patents, which may be relevant to the present invention: Tykwinski, U.S. Pat. No. 4,141,375, issued Feb. 27, 1979, on a knee crutch-cane including a cane having an upper end for being gripped by the user, and a lower end for engaging the floor, and including a cradle for receiving the user's knee attached to the cane between the opposite ends thereof; Monte, U.S. Pat. No. 4,291,715, issued Sep. 29, 1981, on a foot support crutch including a support platform for engaging the user's leg below the knee, and a dual ground supporting arrangement which may have a clutch member to provide some type of level seeking ability; Beatty, U.S. Pat. No. 4,910,927, issued Mar. 27, 1990, on an attachment for existing crutches including a foldable mechanism having a knee supporting platform; MacGregor, U.S. Pat. No. 5,178,595, issued Jan. 12, 1993, on a walker device including an upright staff that extends from the user's pelvis to the ground, with an upper receiving member for receiving and securing the user's thigh to the staff, and a lower receiving member for receiving and securing the user's calf to the staff; Marlatt, U.S. Pat. No. 5,300,016, issued Apr. 5, 1994, on a prosthetic device including a shelf for supporting a user's lower leg in a nonweight-bearing position while supporting the user's knee in a weight bearing position, and a foldable strut extending below the shelf for supporting the user's weight while standing or walking; Bieri, U.S. Pat. No. 5,575,299, issued Nov. 19, 1996, on a walking device having a flat, rectangular foot member, a tubular support member attached to the foot member, and a body member attached to the support member opposite the foot member for being attached to the lower portion of a person's leg; Tisley et al., U.S. Pat. No. 5,746,236, issued May 5, 1998, on a knee crutch including a knee receptacle, one or more legs, an upright, and a handle, allowing the patient to walk by grasping the handle and moving the knee crutch forward, and to stand by resting the abdomen against the handle; and Bierman, U.S. Pat. No. 5,941,263, issued Aug. 24, 1999, on a leg support crutch including a unitary leg cradle conforming generally to a user's thigh, knee and lower leg, and a support strut releasably attached to the cradle and positioned to support the weight of the user when standing or walking.

None of these references, either singly or in combination, disclose or suggest the present invention.

BRIEF SUMMARY OF THE INVENTION

The present invention provides a collapsible knee crutch that is used to assist an individual in walking and to participate in more normalized activities while an injured lower extremity heals. The present invention is to be used by individuals who have sustained an injury to their lower extremity to include the foot and ankle areas, and it serves as an extension of an injured individual's leg, allowing the individual to redistribute weight on the injured side. The present invention has been developed to accommodate different individual's heights, and even to enable one to sit and straighten one's knee with the crutch folded. The present invention can be utilized with standard crutches to allow for both weight bearing and balance. The present invention is fairly lightweight, straps to the lower leg, and is easy to use.

The collapsible knee crutch of the present invention includes an upper leg member, a lower leg member, a lower leg pivot for pivotally attaching the upper and lower leg members together for allowing the lower leg member to pivot between a bent position and an extended position, a support leg member, and a support leg pivot pivotally attaching the lower leg member and the support leg member together for allowing the support leg to pivot between a bent position and an extended position. The lower leg pivot has a pivotal axis located forward of the user's natural knee pivotal axis when the crutch is attached to the user's leg. The support leg member preferably has elongated, spaced apart inside and outside support legs with the outside support leg preferably being longer than the inside support leg.

DETAILED DESCRIPTION OF THE INVENTION

Figure 1:
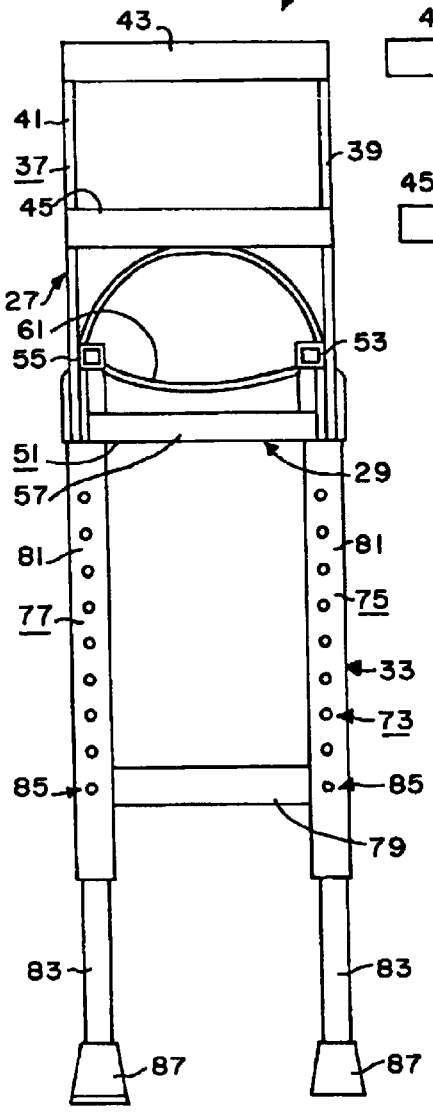
FIG. 1 is a front elevational view of the collapsible knee crutch of the present invention.
Figure 2:
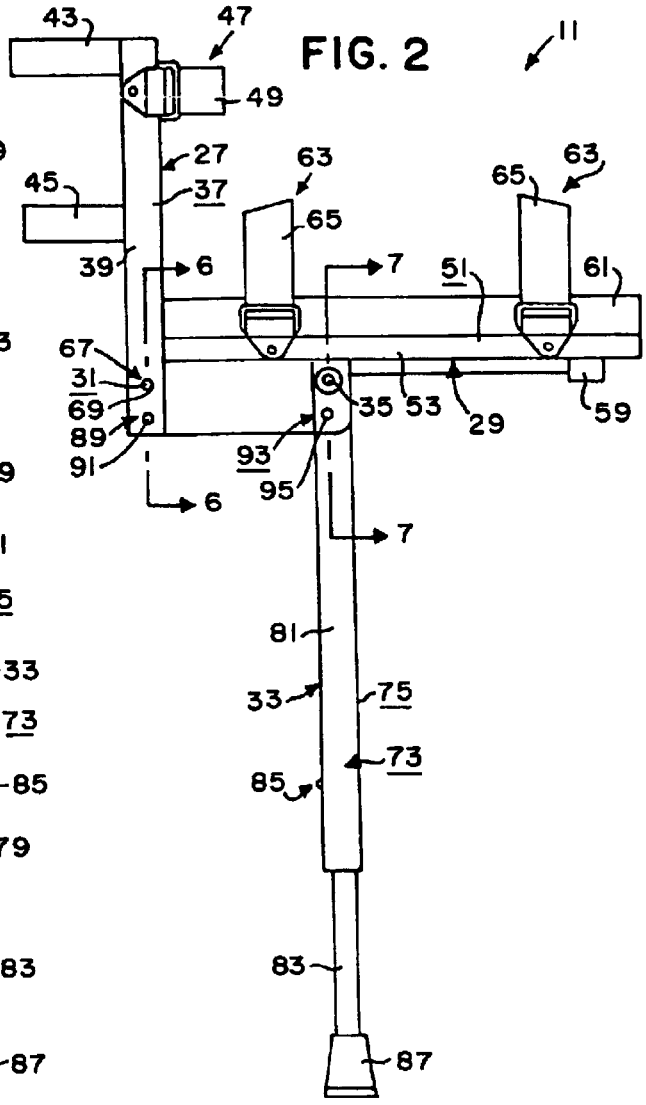
FIG. 2 is a side elevational view of the collapsible knee crutch of the present invention.
Figure 3:
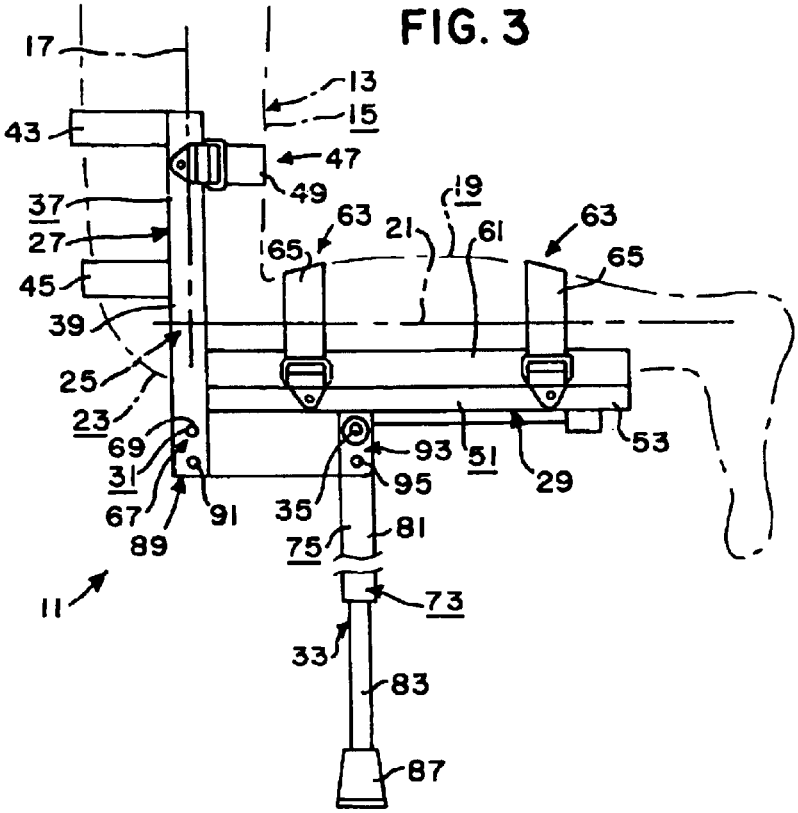
FIG. 3 is a side elevational view of the collapsible knee crutch of the present invention, shown attached to and supporting a user's leg, with the lower leg member in a bent position and an extended position and with the support leg member in an extended position.
Figure 4:
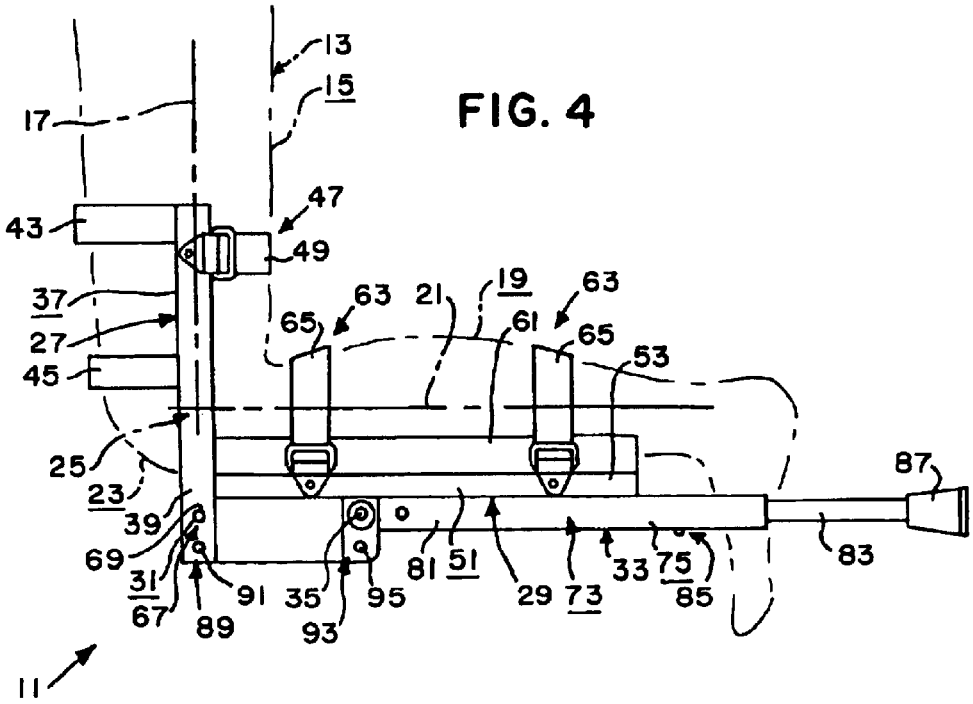
FIG. 4 is a side elevational view of the collapsible knee crutch of the present invention, shown attached to and supporting a user's leg, with the lower leg member in the extended position and with the support leg member in a bent position.
Figure 5:
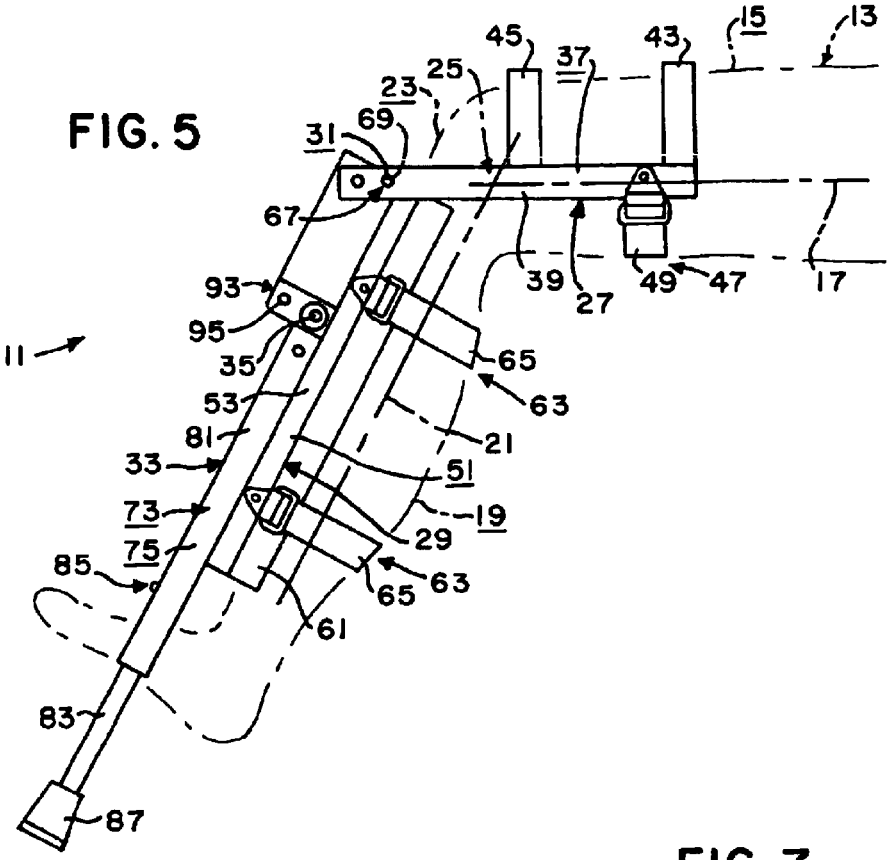
FIG. 5 is a side elevational view of the collapsible knee crutch of the present invention, shown attached to and supporting a user's leg, with the lower leg member in the bent position and with the support leg member in the bent position.
Figure 6:
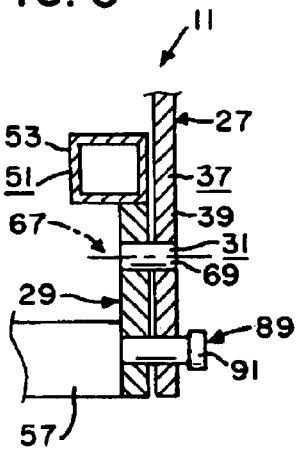
FIG. 6 is a sectional view substantially as taken on line 6—6 of FIG. 2 on a somewhat enlarged scale with portions thereof broken away or omitted for clarity.
Figure 7:
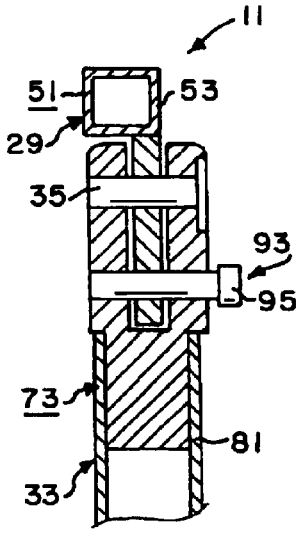
FIG. 7 is a sectional view substantially as taken on line 7—7 of FIG. 2 on a somewhat enlarged scale with portions thereof broken away or omitted for clarity.

A preferred embodiment of the collapsible knee crutch of the present invention is shown in FIGS. 1–7, and identified by the numeral 11. The collapsible knee crutch 11 is used for attaching to and supporting a user's leg 13 during convalescence after foot or ankle injury, foot or ankle surgery, etc. The user's leg 13 typically has an upper leg, or thigh portion, 15 with a longitudinal axis 17, a lower leg, or calf portion, 19 with a longitudinal axis 21, and a natural knee 23 joining the upper and lower legs 15, 19, the natural knee 23 having a natural knee pivotal axis 25 substantially at the intersection between the longitudinal axes 17, 21 of the upper and lower legs 15, 19.

The knee crutch 11 includes an upper leg member 27 for attachment to the user's upper leg 15; a lower leg member 29 for supporting the user's lower leg 19; a lower leg pivot 31 for pivotally attaching the upper leg member 27 and the lower leg member 31 together and for allowing the lower leg member 31 to pivot between a bent position and an extended position; a support leg member 33; and a support leg pivot 35 for pivotally attaching the lower leg member 29 and the support leg member 33 together and for allowing the support leg member 33 to pivot between a bent position and an extended position.

The upper leg member 27 preferably includes a rigid frame 37 having a first side member or plate 39, a second side member or plate 41, a first or upper curved cross member 43 extending between and joining the upper ends of the first and second side plates 39, 41, and a second or lower curved cross member 45 extending between and joining the middle portion of the first and second side plates 39, 41. The first and second side plates 39, 41 and the first and second cross members 43, 45 are machined or molded, or otherwise formed, out of a substantially strong, rigid, lightweight material such as plastic, aluminum, titanium, etc., either as a integral, one-piece unit, or welded or otherwise joined to one another to form a rigid construct, as will now be apparent to those skilled in the art. The frame 37 is sized and shaped to fit the user's upper leg 15, with the side plates 39, 41 extending along the sides of the user's upper leg 15, and with the cross member 43, 45 passing over the front of the user's upper leg 15. Thus, the frame 37 may be provided in various standard sizes (e.g., small, medium and large) or may be provided in a custom size to fit a particular user, etc. Padding or other cushioning material may be provided some or all interior surfaces of the frame 37 to make the upper leg member 27 more comfortable for the user.

The upper leg member 27 preferably includes attachment means 47 such as one or more flexible, adjustable strap assemblies 49 extending between the side plates 39, 41 for passing over the back of the user's upper leg 15 to secure the frame 37 to the user's upper leg 15 as will now be apparent to those skilled in the art.

The lower leg member 29 preferably includes a rigid frame 51 having a first side member or plate 53, a second side member or plate 55, a first or upper cross member 57 extending between and joining the upper ends of the first and second side plates 53, 55, and a second or lower cross member 59 extending between and joining the lower ends of the first and second side plates 53, 55. The first and second side plates 53, 55 and the first and second cross members 57, 59 are machined or molded, or otherwise formed, out of a substantially strong, rigid, lightweight material such as plastic, aluminum, titanium, etc., either as a integral, one-piece unit, or welded or otherwise joined to one another to form a rigid construct, as will now be apparent to those skilled in the art. The upper ends of the side plates 53, 55 are preferably enlarged to allow the desired positioning of the lower leg and support leg pivots 31, 35. The frame 51 is sized and shaped to fit the user's lower leg 19, with the side plates 53, 55 extending along the sides of the user's lower leg 19, and with the cross member 57, 59 passing over the front of the user's lower leg 19. Thus, the frame 51 may be provided in various standard sizes (e.g., small, medium and large) or may be provided in a custom size to fit a particular user, etc. A support shelf or tray 61 is preferably mounted between the side plates 53, 55 for supportingly receiving the front of the user's lower leg 19. Padding or other cushioning material may be provided on the tray 61 to make the lower leg member 29 more comfortable for the user.

The lower leg member 29 preferably includes attachment means 63 such as one or more flexible, adjustable strap assemblies 65 extending between the side plates 53, 55 for passing over the back of the user's lower leg 19 to secure the frame 51 to the user's lower leg 19 as will now be apparent to those skilled in the art.

The lower leg pivot 31 preferably has a pivotal axis 67 located forward of the user's natural knee pivotal axis 25 when the upper leg member 27 is attached to the user's upper leg 15 and the lower leg member 29 is supporting the user's lower leg 19. The lower leg pivot 31 may consist of a first pivot rod 69 extending through the lower end of the first side plate 39 of the frame 37 of the upper leg member 27 and through the upper end of the first side plate 53 of the frame 51 of the lower leg member 29; and a second pivot rod (not shown) extending through the lower end of the second side plate 41 of the frame 37 of the upper leg member 27 and through the upper end of the second side plate 55 of the frame 51 of the lower leg member 29. The pivot rods 69, etc., may be off-the-shelf shoulder screws or the like for allowing the lower leg member 29 to easily pivot relative to the upper leg member 27 between the bent and extended positions as will now be apparent to those skilled in the art.

The support leg member 33 preferably includes a rigid frame 73 having a first or inside support leg 75, a second or outside support leg 77, and one or more cross members 79 extending between and joining the first and second support legs 75, 77. As disclosed hereinabove, the enlarged portions of the upper ends of the side plates 53, 55 of the frame 51 of the lower leg member 29 allow the desired positioning of the support leg pivots 35. The frame 73 is preferably sized to fit the user's height. Thus, the frame 73 may be provided in various standard sizes (e.g., small, medium and large) or may be provided in a custom size to fit a particular user, etc. Preferably, however, the length of the first and second support legs 75, 77 is variable to allow the overall height of the support leg member 33 to be easily adjusted to fit user's of different heights. More specifically, each support leg 75, 77 preferably includes an upper leg 81 and a lower leg 83 slidably mounted within the respective upper leg 81 in a manner so that the overall height of each support leg 75, 77 can be easily adjusted merely by sliding the lower leg 83 in and out of the upper leg 81 as will now be apparent to those skilled in the art. Each lower leg 83 is preferably fixedly but adjustably attached to the respective upper leg 81 via a typical ball-and-detent type attachment means 85 as will now be apparent to those skilled in the art.

The first and second support legs 75, 77 and the cross member 79 are machined or molded, or otherwise formed, out of a substantially strong, rigid, lightweight material such as plastic, aluminum, titanium, etc. The upper legs 81 and cross member 79 may be formed either as a integral, one-piece unit, or welded or otherwise joined to one another to form a rigid construct, as will now be apparent to those skilled in the art. The lower legs 83 are formed as separate components, sized to freely slide within the respective upper legs 81. Rubber feet 87 or the like may be provided on the distal end of each lower leg 83 to allow the lower leg member 29 to securely grip the ground, etc., and make the knee crutch 11 more comfortable for the user.

The second or outside support leg 77 is preferably slightly longer by 0.25 inches (0.635 centimeters) or so, than the first or inside support leg 75. This may be accomplished in various ways now apparent to those skilled in the art such as, for example, by constructing the upper and/or lower legs 81, 83 that form the second or outside support leg 77 slightly longer than the upper and/or lower legs 81, 83 that form the first or inside support leg 75, by merely adjusting the upper and lower legs 81, 83 of the second or outside support leg 77 via the ball-and-detent attachment means 85 to be somewhat longer than the respective upper and lower legs 81, 83 of the first or inside support leg 75, or by merely providing a thicker rubber foot 75 for second or outside support leg 77 than the first or inside support leg 75 as shown in the drawings. Making the second or outside support leg 77 slightly longer than the first or inside support leg 75, should make the knee crutch 11 more stable for the user.

The knee crutch 11 preferably includes a first lock 89 for locking the lower leg member 29 in the bent position with respect to the upper leg member 27. The first lock 89 may consist simply of a pin 91 for extending through a portion of the lower leg member 29 and upper leg member 27 when the lower leg member 29 is in the bent position so that the lower leg member 29 is locked in that bent position until the pin 29 is removed from one or both leg members 27, 29 as will now be apparent to those skilled in the art.

The knee crutch 11 preferably includes a second lock 93 for locking the support leg member 33 in the extended position with respect to the lower leg member 29. The second lock 93 may consist simply of a pin 95 for extending through a portion of the support leg member 33 and lower leg member 29 when the support leg member 33 is in the extended position so that the support leg member 33 is locked in that extended position until the pin 95 is removed from one or both leg members 29, 33 as will now be apparent to those skilled in the art.

The pins 91, 95 may be off-the-shelf pull pins or the like for allowing the easily insertion and removal of the pins 91, 95 to lock and unlock the respective locks 89, 91 as will now be apparent to those skilled in the art.

Although the present invention has been described and illustrated with respect to a preferred embodiment and a preferred use therefor, it is not to be so limited since modifications and changes can be made therein which are within the full intended scope of the invention.

What is claimed is:

1. A collapsible knee crutch for attaching to and supporting a user's leg, the user's leg having an upper leg part and a lower leg part; said collapsible knee crutch comprising:

(a) an upper leg member for attachment to the user's upper leg part;

(b) a lower leg member including a support surface for supporting the user's lower leg part;

(c) a lower leg pivot for pivotally attaching said upper leg member and said lower leg member together and for allowing said lower leg member to pivot between a bent position and an extended position; said lower leg pivot having a pivotal axis located below said support surface of said lower leg member when said lower leg member support surface is oriented parallel to the ground;

(d) a support leg member; and (e) a support leg pivot for pivotally attaching said lower leg member and said support leg member together and for allowing said support leg member to pivot between a bent position and an extended position.

2. The knee crutch of claim 1 in which said support leg member includes an elongated inside support leg and an elongated outside support leg; each of said inside and outside support legs having a first end for attachment to said lower leg member and a second end for engaging a support surface; said outside support leg being longer than said inside support leg.

3. The knee crutch of claim 1 in which is included a first lock for locking said lower leg member in said bent position; and in which is included a second lock for locking said support leg member in said extended position.

4. A collapsible knee crutch for attaching to and supporting a user's leg, the user's leg having an upper leg part and a lower leg part; said collapsible knee crutch comprising:

(a) an upper leg member for attachment to the user's upper leg part;

(b) a lower leg member including a support surface for supporting the user's lower leg part;

(c) a lower leg pivot for pivotally attaching said upper leg member and said lower leg member together and for allowing said lower leg member to pivot between a bent position and an extended position; said lower leg pivot having a pivotal axis located below said support surface of said lower leg member when said lower leg member support surface is oriented parallel to the ground;

(d) a support leg member including elongated, spaced apart inside and outside support legs; said outside support leg being longer than said inside support leg; and (e) a support leg pivot for pivotally attaching said lower leg member and said support leg member together and for allowing said support leg member to pivot between a bent position and an extended position.

* * * * *